US007664273B2

(12) United States Patent
Christensen et al.

(10) Patent No.: US 7,664,273 B2
(45) Date of Patent: Feb. 16, 2010

(54) APPROACH FOR CONTROLLING AUDIO SIGNALS IN REMOTE LOCATION

(75) Inventors: Steve Christensen, Richmond, KY (US); Robert P. Farinelli, Jr., Lexington, KY (US); Randy Fisher, Lexington, KY (US); Raymond Anthony Newman, Cheektowaga, NY (US)

(73) Assignee: ELAN Home Systems, L.L.C., Lexington, KY (US)

( * ) Notice: Subject to any disclaimer, the term of this patent is extended or adjusted under 35 U.S.C. 154(b) by 751 days.

(21) Appl. No.: 10/746,150

(22) Filed: Dec. 22, 2003

(65) Prior Publication Data

US 2004/0175002 A1 Sep. 9, 2004

Related U.S. Application Data

(60) Provisional application No. 60/435,424, filed on Dec. 20, 2002.

(51) Int. Cl.
*G03G 11/00* (2006.01)

(52) U.S. Cl. ..... 381/55; 381/104

(58) Field of Classification Search ..... 381/55, 381/58–59, 61, 104, 107, 81, 119
See application file for complete search history.

(56) References Cited

U.S. PATENT DOCUMENTS 3,446,976 A 5/1969 Shaw
3,518,375 A 6/1970 Hawkins
4,238,724 A 12/1980 Klaus et al.
4,390,834 A 6/1983 Ohshita
4,550,400 A * 10/1985 Henderson et al. ..... 370/458
4,775,766 A 10/1988 Kooy et al.
5,054,076 A * 10/1991 Lowell ..... 381/109
5,131,048 A 7/1992 Farenelli et al.
5,444,676 A * 8/1995 Balsamo et al. ..... 369/4
5,577,128 A * 11/1996 Farinelli, Jr. ..... 381/81
5,734,731 A * 3/1998 Marx ..... 381/119
5,761,320 A * 6/1998 Farinelli et al. ..... 381/81

(Continued)

OTHER PUBLICATIONS

Atlas Sound LP, Switched Whispertouch 70.7-Volt Stereo and Mono Volume Controls, 2001, Printed in U.S.A.

(Continued)

*Primary Examiner*—Xu Mei
*Assistant Examiner*—Lun-See Lao
(74) *Attorney, Agent, or Firm*—Crawford Maunu PLLC

(57) ABSTRACT

An example embodiment is directed to use in a facility benefiting from the distribution of audio throughout different facility zones ("audio zones"), with each audio zone receiving an audio signal from a remotely-located audio distribution controller. For controlling audio at a user-controlled speaker load located in one of the audio zones, a circuit arrangement includes isolation circuit, speaker load circuit, user-input device and an audio control unit. The isolation circuit generates a transformed audio signal by provide an impedance-matched termination and by permitting one of a number of impedance-matching circuits to be set wherein each impedance-matching circuit provides a different amount of electrical power to the speaker load. The speaker load circuit delivers, in response to the transformed audio signal, audible signals in the audio zone. The audio control unit has a microprocessor adapted to control the delivery of the audible signals in response to the input commands generated via the user-input device.

20 Claims, 3 Drawing Sheets

U.S. PATENT DOCUMENTS

| | | | | |
|---|---|---|---|---|
| 5,864,186 | A | 1/1999 | Kurtz et al. | |
| 6,072,879 | A * | 6/2000 | Ouchi et al. | 381/61 |
| 7,184,560 | B2 * | 2/2007 | Ajamian | 381/119 |

OTHER PUBLICATIONS

VC201 Digital Volume Control Keypad. Datasheet [online]. Knoll Systems, [retrieved on Oct. 16, 2002]. Retrieved from the Internet: <http://www.knollsystems.com/vc201.htm >.

Digital Transformer Free Volume Controllers. Datasheet [online]. Knoll Systems, [retrieved on Oct. 16, 2002]. Retrieved from the Internet: <http://www.knollsystems.com/digvol.htm >.

VC220 Digital Volume Controller. Datasheet [online]. Knoll Systems, [retrieved on Oct. 16, 2002]. Retrieved from the Internet: <http://www.knollsystems.com/vc220.htm >.

RAT1 Remote Autotransformer. Datasheet [online]. Xantech Corporation, 2000, [retrieved on Feb. 13, 2002]. Retrieved from the Internet: <http://www.xantech.com/products/p_folder/p_rat1.htm>.

Installation Instructions: RAT1 Remote Autotransformer. Owner Manual [online]. Xantech Corporation, 2000, [retrieved on Feb. 13, 2002]. Retrieved from the Internet: <http://www.xantech.com/products/p_folder/p_rat1.htm>.

MIRV1 IR Motorized Infrared Volume Controller. Datasheet [online]. Xantech Corporation, 2000, [retrieved on Feb. 13, 2002]. Retrieved from the Internet: <http://www.xantech.com/products/p_folder/p_mirv1.htm>.

Installation Instructions: MIRV1 IR/Motorized Volume Controller. Owner Manual [online]. Xantech Corporation, 2000, [retrieved on Feb. 13, 2002]. Retrieved from the Internet: <http://www.xantech.com/products/p_folder/p_mirv1.htm>.

Volume Controls VCPage. Datasheet [online], Audioplex Technology, 2000 [retrieved on Oct. 16, 2002]. Retrieved from the Internet: <http://www.audioplex.com/VCPage.htm>.

Installation Manual: VCMute/VCPage & VCPAGE-Base. Owner Manual [online]. Audioplex Technology, 2000 [retrieved.

Volume Controls VCPage. Datasheet [online]. Audioplex Technology, 2000 [retrieved on Oct. 16, 2002]. Retrieved from the Internet: <http://www.audioplex.com/VCPage.htm>.

Installation Manual: VCMute/VCPage & VCPAGE-Base. Owner Manual [online]. Audioplex Technology, 2000 [retrieved on Oct. 16, 2000]. Retrieved from the Internet: <http://www.audioplex.com/VCPage.htm >.

* cited by examiner

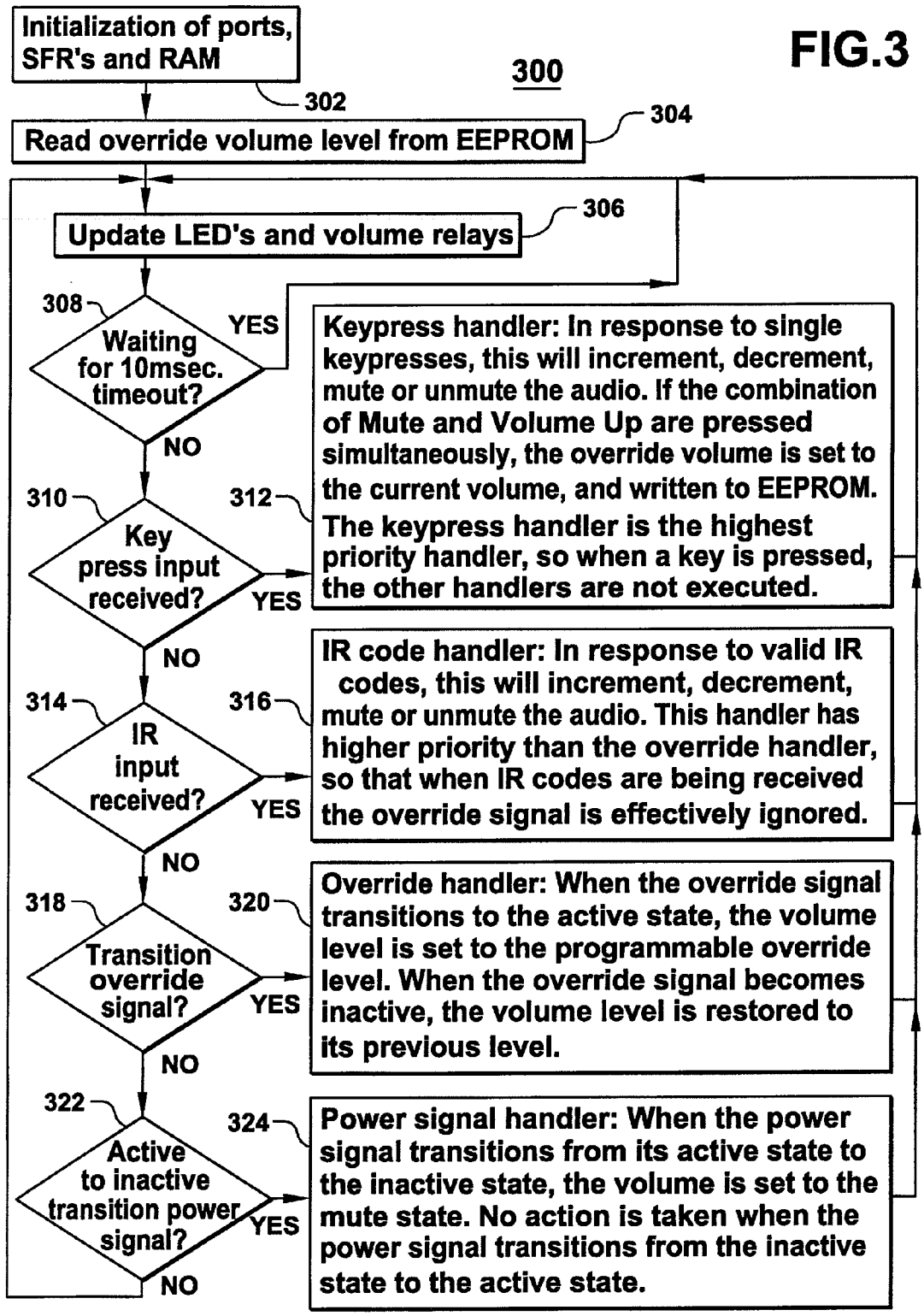
FIG.3
300
Initialization of ports, SFR's and RAM
302
Read override volume level from EEPROM
304
Update LED's and volume relays
306
308
Waiting for 10msec. timeout?
YES
NO
310
Key press input received?
YES
NO
312
Keypress handler: In response to single keypresses, this will increment, decrement, mute or unmute the audio. If the combination of Mute and Volume Up are pressed simultaneously, the override volume is set to the current volume, and written to EEPROM. The keypress handler is the highest priority handler, so when a key is pressed, the other handlers are not executed.
314
IR input received?
YES
NO
316
IR code handler: In response to valid IR codes, this will increment, decrement, mute or unmute the audio. This handler has higher priority than the override handler, so that when IR codes are being received the override signal is effectively ignored.
318
Transition override signal?
YES
NO
320
Override handler: When the override signal transitions to the active state, the volume level is set to the programmable override level. When the override signal becomes inactive, the volume level is restored to its previous level.
322
Active to inactive transition power signal?
YES
NO
324
Power signal handler: When the power signal transitions from its active state to the inactive state, the volume is set to the mute state. No action is taken when the power signal transitions from the inactive state to the active state.

APPROACH FOR CONTROLLING AUDIO SIGNALS IN REMOTE LOCATION

RELATED PATENT DOCUMENTS

This is a conversion of U.S. Provisional Patent Application Ser. No. 60/435,424, entitled "Universal Electronic Volume Control," and filed on Dec. 20, 2002, to which priority is claimed under 35 U.S.C. §119.

FIELD OF THE INVENTION

The present invention relates generally to control schemes for audio signals and more particularly for controlling centrally generated audio signals from remote locations.

BACKGROUND OF THE INVENTION

Audio systems are used in a variety of applications. These applications include consumer and professional applications. Professional applications include entertainment venues such as theaters. For many audio system applications, centrally generated audio is sent to one or more audio zones. For centrally generated audio the input sources are located together at a location that is denoted the central location. This central location can be anywhere in the facility. The centrally generated audio is derived from input sources such as tuners, tape decks, CD players, DVD players, or DSS receivers. A listener located in an audio zone, located remotely from the central location, may use the audio system to listen to audio derived from an input source. Each audio zone can receive audio from the same input source or from distinct input sources depending on the needs of the application and the capabilities of the audio system.

The benefits of an audio system that distributes audio to more than one audio zone include convenient access to audio music in every audio zone within an application (e.g., rooms within a residence), savings in the form of fewer system components, and the ability to provide customized control over the audio as it is distributed to the audio zones. With an audio system that distributes audio the various source components do need to be replicated in each of the various audio zones within a facility.

For some audio systems, a user can not control the audio system from a remote zone. The user must inconveniently go to the central location of the audio system to control the audio music for the remote zone where the user is located. In other audio systems, the system is configured using a relatively elaborate wiring distribution to connect the system's microphones, speakers, and control panels in the various audio zones to a central control circuit which distributes the audio to the zones. In such systems, the user convenience and control over the audio in the zones can be facilitated by providing a control capability located within each remote audio zone. For example, a user can turn down the volume in a particular zone using a manual volume setting control so that the user is not disturbed by continuously playing audio. The user would find it helpful, however, if the volume was returned to its normal listening level in the event that the music is interrupted by a doorbell, a page, or some other special musical or tonal audio signal. Moreover, such an automatic override interruption should be implemented such that no annoying pops are heard at the speaker when an interrupting signal is suddenly presented to the speaker. An ideal audio system provides user control from a remote zone without requiring costly re-routing of control and signal wires in existing systems.

Previous approaches have attempted to improve on some of the above audio-distribution aspects over other features relating to convenience, cost, and/or quality. One approach for remote zone user control implements devices with switches and relays that do not contain any control logic within the device itself. The device may need to be manually reset and may not indicate the on/off status of the audio system. Additionally, if a remote zone volume control is provided, then the volume must be adjusted manually with a rotary or other type switch on the device.

A second approach for remote zone user control uses digital control circuits having up/down volume control. The up/down control is typically implemented with counter logic or a potentiometer. The digital control circuits do not include advanced software control functions and are limited to an incremental up/down control.

A third approach for remote zone user control uses a two piece design that can provide up/down volume control, visual indication of the volume level, and automatic volume resetting after a system shut down. However, the two piece design includes a microprocessor control unit for the remote zone and an additional control unit leading to more difficult installation, particularly for retrofit applications.

Designs of these approaches can benefit from an easier and less time consuming installation and convenient user control from a remote zone. Consequently, realizing an ideal audio system, one that delivers clear audio in a convenient to use manner, minimizes installation time and is adaptable to a various needs associated with audio applications has been challenging.

SUMMARY OF THE INVENTION

The present invention is directed to overcoming the above-mentioned challenges and others related to the types of approaches and implementations discussed above and in other applications. The present invention is exemplified in a number of implementations and applications, some of which are summarized below.

According to an example embodiment of the present invention, a facility-wide audio distribution system delivers controlled audio to user-controlled speaker loads located in remote audio zones. The system includes an audio distribution controller having at least one power amplifier for generating at least one audio signal, and a load arrangement located remote from the audio distribution controller and adapted to receive user-control signals in at least one co-located one of the remote audio zones. The load arrangement includes a speaker load circuit and an isolation circuit for generating at least one transformed audio signal for the speaker load circuit. The isolation circuit is adapted to provide an impedance-matched termination for said at least one audio signal, and the speaker load circuit is adapted to delivering audible signals in the co-located one of the remote audio zones and in response to the user-control signals.

According to another example embodiment, the invention is directed to use in a facility benefiting from the distribution of audio throughout different facility audio zones, with each audio zone receiving an audio signal from a remotely-located audio distribution controller. For controlling audio at a user-controlled speaker load located in one of the audio zones, a circuit arrangement includes isolation circuit, speaker load circuit, user-input device and an audio control unit. The isolation circuit generate a transformed audio signal by provide an impedance-matched termination and by permitting one of a number of impedance-matching circuits to be set wherein each impedance-matching circuit provides a different amount of electrical power to the speaker load. The speaker load circuit delivers, in response to the transformed audio signal, audible signals in the audio zone. The audio control unit has a microprocessor adapted to control the delivery of the audible signals in response to the input commands generated via the user-input device.

The above summary of the present invention is not intended to describe each illustrated embodiment or implementation of the present invention. The figures and the associated discussion that follows more particularly exemplify these embodiments.

BRIEF DESCRIPTION OF THE DRAWINGS

The invention may be more completely understood in consideration of the detailed description of various embodiments of the invention in connection with the accompanying drawings, in which:

FIG. 3 is a flow chart showing one example approach for implementing arrangements discussed in connection with FIGS. 1 and 2, according to various embodiments of the present invention.

Figure 1:
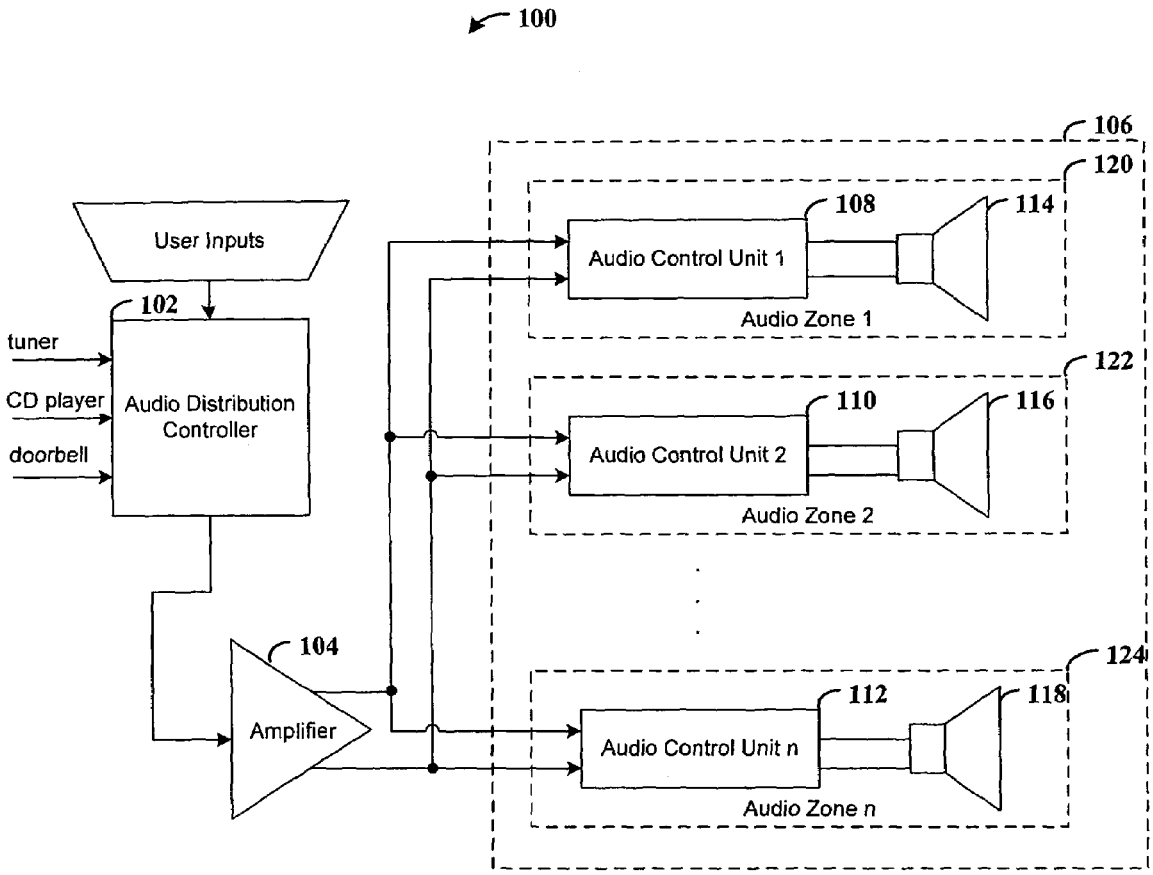
FIG. 1 illustrates a block diagram of an audio processing system in accordance with example embodiments of the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DETAILED DESCRIPTION

The present invention is believed to be applicable to a variety of facility applications utilizing an audio system. The present invention has been found to be particularly advantageous for a facility application in which audio is sent by an audio system to one or more audio zones. The present invention includes audio control units located in each audio zone. The audio control units enable a user to conveniently control local audio volume while located in an audio zone. Impedance matching circuits in the audio control units allow each power amplifier in an audio system to safely deliver the power amplifier output audio signal to speaker loads without overloading the power amplifier and/or independent of volume adjustment. The present invention is not necessarily limited to such applications; various aspects of the invention may be appreciated through a discussion of various examples using this context.

According to an example embodiment of the present invention, an audio system generates audio signals for distribution throughout one or more audio zones within a facility and as exemplified in U.S. Pat. No. 5,131,048 (Farinelli et al.). The audio system receives user inputs for selecting an input source (e.g., tuner, tape deck, CD player, DVD player, or DSS receiver) and audio zone volume levels. The audio system includes one or more power amplifiers with each power amplifier generating an audio channel for distribution to one or more audio zones. Each audio zone includes a speaker load for delivering each audio channel. Collectively the impedance matching circuits for a particular audio channel match the total impedance presented by the speaker loads for that channel to an impedance within the impedance rating of the power amplifier, ensuring safe operation of the power amplifier. For each audio channel the impedance matching circuits for the channel within the remote audio control units are connected in parallel to the power amplifier for the audio channel. In one example embodiment, using panel-located settings to prevent dropping below the minimum load impedance rating of the amplifier, a user can independently adjust the local audio zone at each audio control unit without adversely affecting the total impedance load observed by the associated power amplifier. A user can adjust the volume level and mute the local audio zone with the local audio control unit.

For example, a first user in a first zone can listen to the audio at the maximum volume level, a second user in a second zone can listen to the same audio at a barely audible level, and a third user in a third zone can mute the same audio. All three users in the three separate zones can independently listen to the audio at any desired volume level. For any user listening preference, the total speaker impedance for each channel is matched to not exceed the impedance rating of the power amplifier for the audio channel. The power amplifier delivers the audio channel to its speaker loads in a safe manner regardless of user listening preferences.

FIG. 1 illustrates an audio system for distributing and controlling audio signals throughout a facility in accordance with various embodiments of the present invention. The audio system 100 generates and delivers audio signals to one or more audio zones. The audio system 100 includes an audio distribution controller 102, one or more power amplifiers 104, and a grouping of audio zones 106.

The audio distribution controller 102 generates one or more audio channels. The user can select an input source (e.g., tuners, tape decks, CD players, DVD players, or DSS receivers) and volume level or muting. The audio distribution controller 102 also generates an intermittent audio tone in response to certain inputs such as a doorbell or page. An intermittent audio tone can temporarily interrupt the audio signals if the user has previously enabled interruption. The audio distribution controller 102 sends the audio signals received from an input source or generated in response to an intermittent input to the power amplifiers 104, which each amplify an audio input signal for a channel to generate an audio output signal. The audio output signals from power amplifiers 104 are sent to the grouping of audio zones 106. FIG. 1 shows an audio system 100 with a single audio channel and hence a single power amplifier 104. For an audio system with a plurality of channels such as stereo audio with a right and left channels there is a corresponding plurality of power amplifiers 104.

The grouping of audio zones 106 contains one or more audio zones 120, 122, and 124. Each audio zone 120, 122, and 124 contains an audio control unit and one or more speaker loads; for example, audio zone 120 contains audio control unit 108 and speaker load 114. FIG. 1 shows an audio system 100 with a single audio channel. For an audio system with a plurality of channels there is a corresponding plurality of speaker loads in each audio zone, but there remains one audio control unit per audio zone. Each audio control unit 108, 110, and 112 contains an impedance matching circuit that sends transformed output signals to the respective speaker loads 114, 116, and 118. The impedance matching circuit generates the transformed output signal based on a transformation factor, which ideally equals the ratio of minimum rated impedance of the power amplifier 104 to the total impedance of the speaker loads 114, 116, and 118 receiving the transformed output signal. A variety of fixed transformation factors are allowed by the impedance matching circuit via a user controlled switch, jumper setting, or other type of selector. A fixed transformation factor is selected that most closely matches the ideal transformation factor while remaining within the impedance rating of the power amplifier.

Each audio control unit has at least one audio transformer for matching the impedance of the power amplifier 104 for an audio channel with the total impedance of the speaker loads 114, 116, and 118 for that channel. A typical audio control unit includes one audio transformer for a left speaker channel and one audio transformer for a right speaker channel. Each audio control unit coupled to a power amplifier 104 should have the same transformation factor (impedance match setting) in each audio transformer for optimal matching and performance. Also, each audio control unit enables a user to adjust the volume level and muting without returning to the audio distribution controller 102. Override controls are used to control the volume level of the interruption of an audio channel with an intermittent audio tone. A user can independently control each audio control unit without affecting the total speaker load impedance observed by the power amplifier 104.

For an example embodiment, a first user in audio zone 120 with audio control unit 108 and speaker load 114 can listen to an audio channel at a maximum volume level, while a second user in audio zone 122 with audio control unit 110 and speaker load 116 can mute the same audio channel. Both users in the separate audio zones 120 and 122 can independently control the volume level of the audio channel. For any user listening preference, the impedance rating of the driving power amplifier 104 is met by the total impedance presented by the speaker loads 114, 116, and 118 by setting the transformation factor for each audio control unit 108, 110, and 112 in an appropriate manner. The power amplifier 104 delivers the audio to the speaker loads 114, 116, and 118 in a safe manner regardless of user listening preferences.

Figure 2:
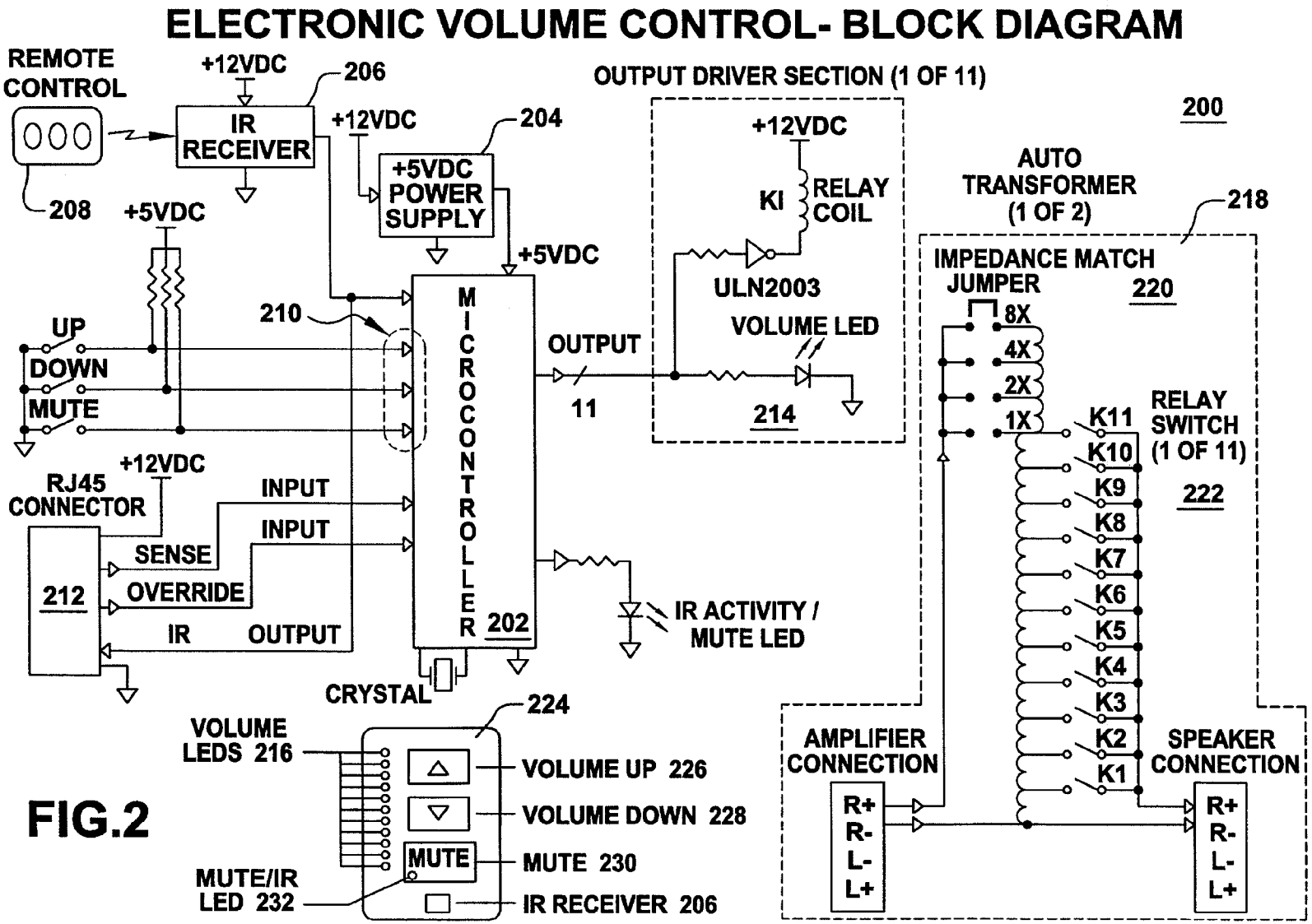
FIG. 2 shows a circuit-level diagram in accordance with other example embodiments of the present invention.

FIG. 2 illustrates an audio control unit in accordance with various embodiments of the present invention. An audio control unit 200, typically located in a remote audio zone, provides impedance matching controls which protect a power amplifier from damage and user controls for the audio zone. The audio control unit 200 includes a microcontroller 202, power supply 204, a connector block 212, output driver blocks 214, one or more audio transformer blocks 218, and a keypad 224.

The microcontroller 202 generates output signal indicators, such as volume level and mute indicators, in response to input signals, such as key press inputs, infrared (IR) inputs, a sense input, and an override input. The microcontroller 202 receives key press inputs 210 from a keypad 224. Volume up 226, volume down 228, and mute 230 are example key press inputs 210. The microcontroller 202 receives IR inputs from an IR remote controller 208 via IR receiver 206. The IR inputs implement similar functionality as the key press inputs 210, but from an IR remote controller 208 at a remote distance with respect to the rest of the audio control unit 200. The microcontroller 202 receives a sense and an override input signals from an infrared (IR) pass-through connector block 212 that interfaces with a main control unit (not shown) of an audio system, where the main control unit is functionally similar to the audio distribution controller 102 in FIG. 1. The connector block 212 permits an interface with IR-driven output devices (e.g., an external CD player).

The main control unit sends an activated sense signal if the audio system voltage supply transitions from active to inactive, which occurs for example when a user turns the audio system power "OFF". The activated sense input causes the microcontroller 202 to set the volume level to mute. No action is taken upon an inactivated sense signal, which indicates the audio system voltage supply is transitioning from inactive to active. A user in a remote audio zone needs to physically press a key input to turn "ON" the audio control unit 200 after the audio voltage supply transitions from inactive to active, thus ensuring that a user in each remote audio zone desires to listen to a reactivated audio signal.

An activated override input indicates that the main control unit is generating an intermittent audio tone in response to a doorbell or page signal within a facility. The main control unit sends the activated override input to the microcontroller 202 via a connector block 212. The microcontroller 202 processes the activated override input, which causes the interrupting intermittent audio tone to interrupt the current audio signal at a predetermined volume level. A user can preset the intermittent audio tone volume level with the key press inputs 210 independent from the normal audio volume level of the audio control unit 200. For example, a user can simultaneously press the volume up 226 and mute 230 keys to increase the volume level of an override signal, which is indicated by a blinking mute LED 232.

Each audio transformer block 218 generates a transformed audio signal from the audio signal received from a power amplifier (not shown) having similar functionality as the power amplifier 104 in FIG. 1. Each audio transformer block 218 sends its transformed audio signal to a speaker load (not shown). For stereo audio there are two audio transformer blocks 218, one for each of the right and left channels. The audio transformer blocks 218 in the audio zones that correspond to a particular audio channel match the impedance of the power amplifier for the channel with the total impedance of the speaker loads in the audio zones driven by the power amplifier, thus preventing overload damage to the power amplifier.

An audio transformer block 218 includes an impedance matching jumper block 220 and a relay block 222. The jumper block 220 generates the transformed output signal based on a transformation factor, which ideally equals the ratio of minimum rated impedance of the power amplifier to the total impedance of the channel's speaker load. A variety of fixed transformation factors are selectable using the jumper block 220, which can be implemented as a switch, jumper setting, or other type of selector. Impedance matching prevents the occurrence of a total speaker load for a channel that is less than the minimum impedance allowed by the power amplifier 104 for the channel, thus preventing overload damage of the power amplifier.

Audio transform blocks 218 also enable a listener to adjust the volume of the audio in the audio zone where an audio control unit 200 is located. Microcontroller inputs, such as key press inputs 210 from keypad 224 or IR inputs from the IR remote control 208, send an adjust volume signal to the microcontroller 202. Microcontroller 202 controls the relay block 222 via output driver block 214 in one or more audio transformers 218 to adjust the volume level. The relay block 222 includes a plurality of relay switches. A relay switch that transitions from an open to closed position provides an incremental increase in volume level. A relay switch that transitions from a closed to an open position provides an incremental decrease in volume level. The microcontroller 202 controls the volume level by changing the position of relay switches within the relay block 222. Each audio transform block 218 receives an audio signal from a power amplifier, multiplies the audio signal by the transformation factor to generate the transformed audio signal, and sends a scaled transformed audio signal to a speaker load, where the scaling is based on the selected relay that is closed and the impedance-matched jumper settings at jumper block 220. If relay K-11 (within jumper block 220) is closed, then the audio transform block generates the maximum audio signal. If all relay switches are open, then the audio transform block generates a muted audio signal.

The output driver block 214 activates or inactivates a plurality of light emitting diodes (LED) and at the same time closes or opens respectively a corresponding relay in relay block 222 in response to the inputs received by the microcontroller 202. The volume LEDs 216 and mute LED 232 are displayed on the keypad 224. Each active (lit) volume LED corresponds to a closed relay switch in the relay block 222. For example, for all volume LEDs to be active, relay K-11 (within jumper block 220) is closed. The microcontroller 202 activates or inactivates a mute LED 232 in response to a mute signal from a mute 230 key press input, IR receiver 206, or a sense input. An active (lit) mute LED 232 indicates that a muted audio channel occurs for the audio control unit 200 or that IR inputs are currently being received from the IR remote control 208.

A user controls volume level and mute by using key press inputs 210 from keypad 224 and/or an IR remote controller 208 for an audio control unit 200 located in an audio zone within a facility. A microcontroller 202 determines the order in which inputs are processed, if more than one input occurs simultaneously. Impedance matching controls are provided by an impedance matching block 220 in audio transform blocks 218, thus protecting a coupled power amplifier from damage due to overload conditions.

For an example embodiment, a first user in a first sub-zone of a first audio zone and a second user in a second sub-zone of a first audio zone with a first audio control unit coupled to a first speaker load can listen to an audio channel at a maximum volume level using a first keypad (keypad 224) located in the first sub-zone and/or a second keypad located in the second sub-zone, while a third user of a second audio zone with a second audio control unit coupled to a second speaker load can mute the same audio channel using a third keypad. Each user can independently control each audio zone using a keypad. The first and second users are required to listen to the same volume level as they share the same audio control unit. However, either user can control the volume level from their respective sub-zone (e.g., master bath and master bedroom). Also, wall control clutter is reduced by having two keypads coupled to the same audio zone as opposed to having a separate audio zone for each keypad. For any user listening preference, the minimum impedance of the driving power amplifier is matched to the total impedance of the speaker loads being driven by the power amplifier by setting the transformation factor for each audio control unit in an appropriate manner. The power amplifier delivers the audio signal to the speaker loads in a safe manner regardless of user listening preferences.

FIG. 3 is flow chart illustrating a method for audio control from a remote audio zone in accordance with various embodiments of the present invention. The audio control method 300 illustrates functional operations of an audio control unit being controlled from a remote audio zone. The audio control unit has similar functionality as an audio control unit 200 in FIG. 2. An audio system includes one or more audio control units for distributing audio music throughout a facility.

Initialization of an audio system including the audio control units occurs at block 302. Power applied to the audio control units enables the microprocessor to initialize and begin the illustrated looping for user inputs. Various memory ports of various components of an audio system are initialized at block 302. A user can turn on an audio control unit by pressing any keypad input (e.g., mute, volume up, or volume down) or by pressing any button on the IR remote controller (e.g., ON, volume up, or volume down), other than the "OFF" button. If the audio control unit receives a mute key press, "ON" command from the IR remote controller, or source select IR command, then the volume level is restored to the same level at the time the audio control unit was turned "OFF". If the audio control unit receives a volume up key press, volume up command from the IR remote controller, or volume up command from the IR remote controller, then the volume level is restored to the same level at the time the audio control unit was turned "OFF". If the audio control unit receives a volume down key press, volume down command from the IR remote controller, or volume down command from the IR remote controller, then the volume level is restored to the lowest audible level.

The volume level of an override input (e.g., intermittent doorbell or page tone) is read from an electrically erasable programmable read only memory (EEPROM) for each audio control unit at block 304. An installer typically sets the volume level for the override input during the installation. A user can change the volume level by using a keypad and simultaneously pressing the mute and volume up/down keys.

At block 306, an audio control unit updates volume relay switches, volume LEDs, and a mute LED in response to any volume, mute, sense, or override input signals received by the audio control unit. If a microcontroller having similar functionality as a microcontroller 202 in FIG. 2 waits for a ten millisecond timeout at block 308, meaning a new input signal is not accepted for a ten millisecond time period, then LEDs and volume relay switches are again updated at block 306. If the microcontroller does not wait for a ten millisecond timeout at block 308, meaning a new input signal is accepted within a ten millisecond time period, then the microcontroller checks for key press inputs at block 310. If the microcontroller receives one or more key press inputs at block 310, then the microcontroller implements various functional operations at block 312. A single key press input (e.g., volume up, volume down, or mute) affects the volume control of an audio signal. For example, a volume up key press increments, a volume down key press decrements, and a mute key press mutes (disables) or enables the volume of an audio signal. A dual key press input (e.g., simultaneous mute and volume up key press) changes the override volume level. Key press inputs received by the microcontroller having similar functionality as a microcontroller 202 in FIG. 2, before any other inputs received by the microcontroller.

If one or more keys are not pressed at block 310, then the microcontroller checks for IR inputs at block 314 via an IR receiver responsive to an IR remote controller. If the microcontroller receives IR inputs at block 314, then the microcontroller implements various functional operations at block 316. An IR input (e.g., volume up, volume down, or mute) affects the volume control of an audio signal. For example, a volume up IR input increments, a volume down IR input decrements, and a mute IR input mutes (disables) or enables the volume of an audio signal. IR inputs received by the microcontroller are processed after the key press inputs, but before any other inputs received by the microcontroller.

If IR inputs are not received by the microcontroller at block 314, then the microcontroller checks for a transition or change in the override input (e.g., intermittent doorbell or page tone) at block 318. If the microcontroller receives an active override input at block 318, then the microcontroller activates the override function at block 320. The override function activates the unit to the panel-programmed override state. Once the active override input transitions to an inactive override input, the original state of the unit is restored (the previous state). An override input received by the microcontroller is processed after the key press and IR inputs, but before any other inputs received by the microcontroller.

If a change in the override input is not received by the microcontroller at block 318, then the microcontroller checks for an active to inactive transition in the power sense input (e.g., audio system power turning "OFF") at block 322. If the microcontroller receives an activate to inactive transition in the power sense input at block 322, then the microcontroller implements the power sense function at block 324. The power sense function mutes the volume of the audio signal received by the audio control unit. Once the inactive power sense input transitions to an active power sense input (e.g., audio system power turning "ON"), the volume of the audio signal remains muted until a key press input is received by the microcontroller. For example, a first user turns "OFF" an audio system and then turns "ON" the audio system. However, a second user in a remote location may not desire to listen to audio. The second user must press a key press input to restore the volume level of the audio control unit in the remote location. A power sense input received by the microcontroller is processed after all other inputs received by the microcontroller.

After the microcontroller implements a functional operation at block 312, block 316, block 320, or block 324 the LEDs and volume relay switches are updated at block 306. If no active to inactive transition occurs in the power sense input at block 322, then LEDs and volume relays are updated at block 306 provided new functional operations occur at block 312, block 316, block 320, or block 324.

For an example embodiment of the present invention, a first user initializes an audio system by turning the system power "ON" at block 302. The first user selects an input source, volume level, and audio zone(s) for listening to the music. A remote audio zone receives the audio signal. A second user in the remote audio zone turns the audio control unit power "ON" by using an IR remote control and pressing the ON button at block 302. The audio control unit coupled to a speaker load delivers the audio signal at the last volume level setting of the audio control unit. The microcontroller reads the previous override volume level from EEPROM at block 304. The LEDs and volume relays are restored to their previous values at block 306. The microcontroller does not wait for a ten millisecond timeout at block 308, rather the microcontroller checks for key press inputs at block 310. No key press inputs are received at block 310, the microcontroller than detects an IR input at block 314 in response to the second user pressing a volume up button on the IR remote control. The microcontroller increments the volume level at block 316, then LEDs and volume relays are updated at block 306. A third user presses a volume down key press input, which is detected by the microcontroller at block 310. The microcontroller decrements the volume level at block 316, then LEDs and volume relays are updated at block 306. Next, the second and third users send simultaneous inputs. The second user inputs a volume up command with the IR remote controller and the third user inputs a volume down command with a key press. The microcontroller receives both commands at the same time and executes the highest priority command first. Any key press input takes precedence over IR inputs for this particular embodiment. The microcontroller executes the volume down key press prior to the volume up IR input. The priority of inputs is determined under software control by the microcontroller.

Other aspects and embodiments of the present invention will be apparent to those skilled in the art from consideration of the specification and practice of the invention disclosed herein. It is intended that the specification and illustrated embodiments be considered as examples only, with a true scope and spirit of the invention being indicated by the following claims.

We claim:

1. An arrangement for use in a facility with a plurality of audio zones receiving at least one audio signal from a remotely-located audio distribution controller—and for controlling audio at a user-controlled speaker load located in at least one of the audio zones, the arrangement comprising:

an isolation circuit for generating at least one transformed audio signal in response to receiving said at least one audio signal, the isolation circuit including an impedance-matching circuit that provides impedance-matched termination for said at least one audio signal, the impedance-matched termination adapted to provide a selection between a number of settings each setting for the impedance-matching circuit having a different maximum limit on an amount of electrical power to the speaker load and a volume control limited by a maximum limit corresponding to a currently-selected setting for the impedance-matched termination;

a speaker load circuit for delivering, in response to said at least one transformed audio signal, audible signals in the at least one of the audio zones;

a user-input device coupled to provide input commands; and an audio control unit located in said at least one of the audio zones and remote from the audio distribution controller, the audio control unit having a microprocessor adapted to control the delivery of the audible signals in response to the input commands.

2. An arrangement for controlling audio, according to claim 1, wherein the user-input device includes front panel user-communication selectors for sending commands to the microprocessor.

3. An arrangement for controlling audio, according to claim 1, wherein the user-input device includes front panel wireless communication means for sending commands to the microprocessor.

4. An arrangement for controlling audio, according to claim 1, further including an infrared control circuit that is coupled to the microprocessor, and wherein the microprocessor is responsive to stimulus from infrared input for remote control of external system equipment.

5. An arrangement for controlling audio, according to claim 4, wherein the microprocessor, in response to stimulus from infrared input, is further adapted to provide visually-recognizable indications of a volume status.

6. An arrangement for controlling audio, according to claim 1, further including an infrared control circuit that is coupled to the microprocessor, and wherein the microprocessor is responsive to stimulus from infrared input and the infrared control circuit provides pass-through infrared signaling for remotely controlling external system equipment.

7. An arrangement for controlling audio, according to claim 1, further including an infrared control circuit that is coupled to the microprocessor, and wherein the microprocessor is responsive to stimulus from both a user-engaged input and an infrared input.

8. An arrangement for controlling audio, according to claim 7, wherein the microprocessor is adapted to respond to a condition in which both the user-engaged input and the infrared input are activated simultaneously, by processing the user-engaged input over the infrared input and by providing visual indication of the input command.

9. An arrangement for controlling audio, according to claim 1, further including a separate panel circuit connection for proving an override command to the audio control unit, wherein the override command causes the audio control unit to switch to a predetermined override setting as determined by user commands previously received by the audio control unit and regardless of a current state of a current volume setting, to provide visual indication of the override level setting, and to revert back to a pre-override state of the audio control unit in response to an override signal being removed.

10. An arrangement for controlling audio, according to claim 9, wherein the microprocessor is adapted to respond to stimulus from both the override command and a user-engaged input, and to respond to the user-engaged input being activated during processing of the override command, by processing the user-engaged input over the override command and by ignoring the override command until the override command is removed and then reapplied at the separate panel circuit connection.

11. An arrangement for controlling audio, according to claim 1, further including a separate panel circuit connection for proving an override command to the audio control unit, wherein the override command causes the audio control unit to mute audio.

12. An arrangement for controlling audio, according to claim 1, wherein the microprocessor responds to the input commands by controlling audio volume through the speaker load.

13. An arrangement for controlling audio, according to claim 1, wherein the microprocessor is responsive to the user input commands for selectively setting ones of the impedance-matching circuits.

14. An arrangement for controlling audio, according to claim 1, further including an infrared control circuit that is coupled to the microprocessor, and wherein the microprocessor is responsive to stimulus from infrared input for controlling audio volume through the speaker load.

15. An arrangement for controlling audio, according to claim 1, further including an infrared control circuit that is coupled to the microprocessor, and wherein the microprocessor is responsive to stimulus from infrared input for selectively setting ones of the impedance-matching circuits.

16. An arrangement for controlling audio, according to claim 1, further including an infrared control circuit that is coupled to the microprocessor, and wherein the microprocessor is responsive to stimulus from infrared input for activating visual indicators associated with ones of the impedance-matching circuits.

17. The arrangement of claim 1, further comprising an infrared control circuit that is coupled to the microprocessor, and wherein the microprocessor is responsive to stimulus from infrared input for controlling audio volume.

18. The arrangement of claim 1, further comprising an infrared control circuit that is coupled to the microprocessor, and wherein the microprocessor is responsive to stimulus from infrared input for selectively controlling the impedance-matching circuit.

19. The arrangement of claim 1, further comprising an infrared control circuit that is coupled to the microprocessor, and wherein the microprocessor is responsive to stimulus from infrared input for activating visual indicators associated with the impedance-matching circuit.

20. For use in a facility with a plurality of audio zones receiving at least one audio signal from a remotely-located audio distribution controller, an arrangement for controlling audio at a user-controlled speaker load located in at least one of the audio zones, comprising:

means for generating at least one transformed audio signal in response to receiving said at least one audio signal, for providing an impedance-matched termination for said at least one audio signal, and for setting one of a number of impedance-matching circuits wherein each impedance-matching circuit is adapted to provide a different amount of electrical power to the speaker load;

a speaker load circuit for delivering, in response to said at least one transformed audio signal, audible signals in the at least one of the audio zones;

user-input means for providing input commands; and an audio control unit located in said at least one of the audio zones and remote from the audio distribution controller, the audio control unit having a microprocessor adapted to control the delivery of the audible signals in response to the input commands.

* * * * *